US007218186B2

(12) United States Patent
Chen

(10) Patent No.: US 7,218,186 B2
(45) Date of Patent: May 15, 2007

(54) DIRECTIONAL COUPLER

(75) Inventor: Lu Chen, Brooklyn, NY (US)

(73) Assignee: Scientific Components Corporation, Brooklyn, NY (US)

( * ) Notice: Subject to any disclaimer, the term of this patent is extended or adjusted under 35 U.S.C. 154(b) by 0 days.

(21) Appl. No.: 10/810,416

(22) Filed: Mar. 29, 2004

(65) Prior Publication Data

US 2005/0212617 A1 Sep. 29, 2005

(51) Int. Cl.
*H01P 3/08* (2006.01)
*H01P 5/18* (2006.01)

(52) U.S. Cl. ..... 333/116; 333/246

(58) Field of Classification Search ..... 333/101, 333/109, 116
See application file for complete search history.

(56) References Cited

U.S. PATENT DOCUMENTS 5,177,453 A * 1/1993 Russell et al. ..... 330/284
5,689,217 A * 11/1997 Gu et al. ..... 333/116
5,742,210 A * 4/1998 Chaturvedi et al. ..... 333/116
6,150,898 A * 11/2000 Kushitani et al. ..... 333/116
6,756,859 B2 * 6/2004 Kodim ..... 333/101
6,791,274 B1 * 9/2004 Hauer et al. ..... 315/111.21
6,804,099 B2 * 10/2004 Michon et al. ..... 361/91.1

* cited by examiner

*Primary Examiner*—Dean Takaoka
(74) *Attorney, Agent, or Firm*—Siegmar Silber

(57) ABSTRACT

A directional coupler for low frequencies that is small and can handle high power levels. The directional coupler includes a pair of circuit lines having an input port, an output port, a forward coupled port and a reverse coupled port. The circuit lines are located proximate to each other such that they are electromagnetically coupled. A low pass filter is connected to the forward coupled port. The low pass filter shifts the operating frequency of the directional coupler.

22 Claims, 11 Drawing Sheets

DIRECTIONAL COUPLER

BACKGROUND

1. Field of the Invention

This invention relates to directional couplers in general and more particularly to a directional coupler for low frequencies that has good power handling and a small package size.

2. Description of Related Art

Directional couplers are used in a variety of applications in the RF and microwave frequency range. FIG. 1 shows a schematic diagram of a prior art directional coupler 20 including a pair of coupled circuit lines 22 and 24. Circuit lines 22 and 24 would typically be formed in a stripline configuration. The directional coupler 20 has four ports, an input port 25, an output port 26, a forward coupled port 27 and a reverse coupled port 28. An input signal or power applied to the input port 25 will go mainly to the output port 26. A portion of the input signal will be electromagnetically coupled to circuit line 24 and appear mostly at forward coupled port 27. A very small portion of the signal will go to the coupled reverse port 28.

The electrical signal coupled to the forward and reverse ports depends upon the coupled circuit line characteristic impedance and the coupling between the lines. Directivity is a measure of the bi-directional coupler differentiation.

Directional couplers using stripline configurations have been applied to higher frequency applications, typically above 600 MHz. The length of the coupled lines is typically set at one quarter of the wavelength at the center frequency. The directional coupler 20 of FIG. 1 is impractical for higher frequency applications. Directional couplers operating at lower frequencies are often faced with size and space constraints, which require the use of transformers to handle the power levels. The use of transformers add higher costs to the product and result in a larger overall package.

A current unmet need exists for a directional coupler that can operate at low frequencies, with minimal size and improved electrical performance.

SUMMARY

It is a feature of the invention to provide a directional coupler that has a small size with good electrical performance.

It is a feature of the invention to provide a directional coupler that can be used for low frequencies with high power.

Another feature of the invention is to provide a directional coupler that includes a first circuit line that has a first end and a second end. An input port is connected to the first end and an output port is connected to the second end. The second circuit line has a third end and a fourth end. The circuit lines are located proximate to each other such that they are electromagnetically coupled. A forward coupled port is connected to the third end and a reverse coupled port is connected to the fourth end. A low pass filter is connected to the forward coupled port. The low pass filter shifts the operating frequency of the directional coupler.

BRIEF DESCRIPTION OF THE DRAWINGS

It is noted that the drawings of the invention are not to scale. In the drawings, like numbering represents like elements between the drawings.

DETAILED DESCRIPTION

Figure 1:
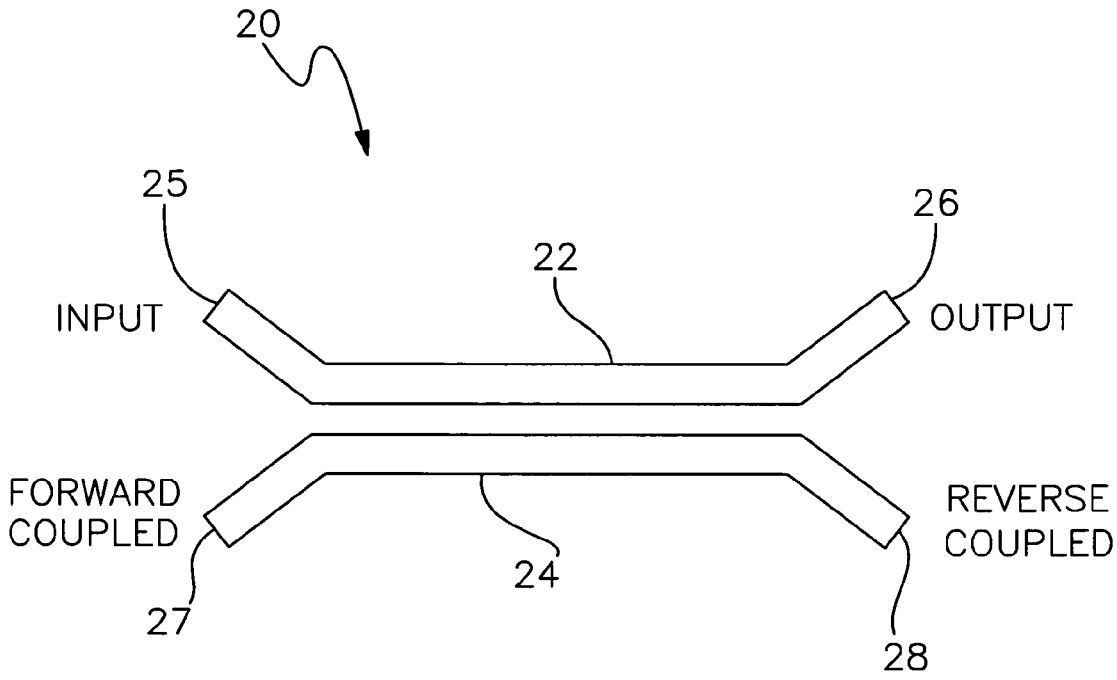
FIG. 1 is a schematic drawing of a conventional directional coupler.
Figure 2:
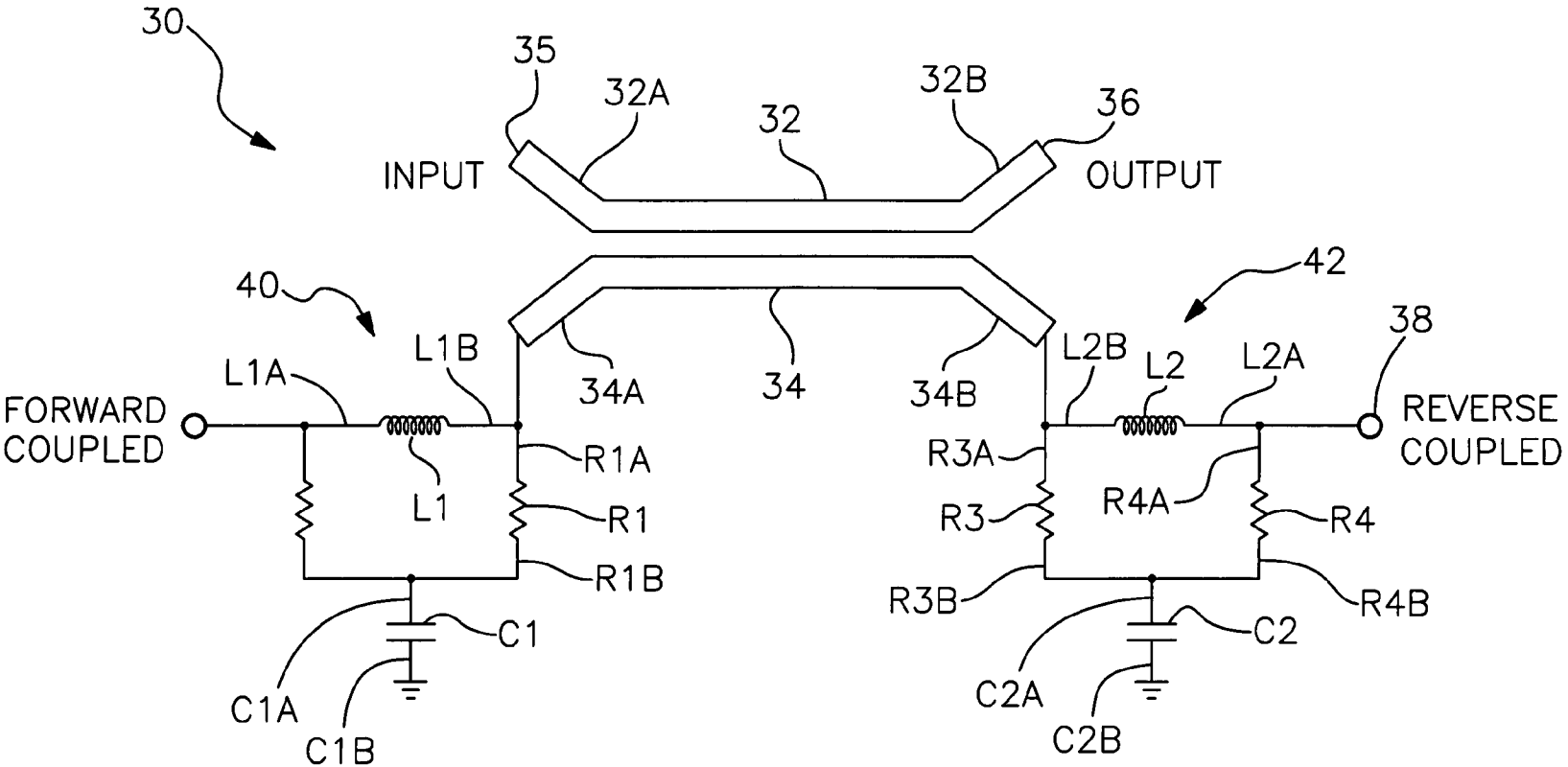
FIG. 2 is a schematic drawing of a directional coupler in accordance with the present invention.

FIG. 2 shows a schematic drawing of a directional coupler 30 in accordance with the present invention. Directional coupler 30 has a pair of coupled circuit lines 32 and 34. Circuit lines 32 and 34 are typically formed in a stripline configuration as will be discussed later. Circuit line 32 has ends 32A and 32B. Circuit line 34 has ends 34A and 34B. The directional coupler 30 has four ports, an input port 35, an output port 36, a forward coupled port 37 and a reverse coupled port 38. Input port 35 is connected to end 32A. Output port 36 is connected to end 32B.

A low pass filter 40 is connected between end 34A and forward coupled port 37. Similarly, another low pass filter 42 is connected between end 34B and reverse coupled port 38.

Low pass filter 40 has an inductor L1 with ends L1A and L1B. End L1A is connected to forward coupled port 37 and end L1B is connected to circuit line end 34A. Resistor R1 has ends R1A and R1B. End R1A is connected to the junction of circuit line end 34A and inductor end L1B. Resistor R2 has ends R2A and R2B. End R2A is connected to the junction of forward coupled port 37 and inductor end L1A. A capacitor C1 has ends C1A and C1B. Capacitor end C1A is commoned with resistor ends R1B and R2B. Capacitor end C1B is connected to ground.

Low pass filter 42 has an inductor L2 with ends L2A and L2B. End L2A is connected to reverse coupled port 38 and end L2B is connected to circuit line end 34B. Resistor R3 has ends R3A and R3B. End R3A is connected to the junction of circuit line end 34B and inductor end L2B. Resistor R4 has ends R4A and R4B. End R4A is connected to the junction of reverse coupled port 38 and inductor end L2A. A capacitor C2 has ends C2A and C2B. Capacitor end C2A is commoned with resistor ends R3B and R4B. Capacitor end C2B is connected to ground.

Directional coupler 30 can be implemented with circuit lines 32 and 34 having an impedance of 50 ohms. Typical values of resistor R1, R2, R3 and R4 is 50 ohms, capacitor C1 and C2 is 2.4 picofarads and for inductors L1 and L2 is 10 nanohenries.

Directional coupler 30 is a bi-directional coupler. Low pass filters 40 and 42 are constant impedance filters. The use of low pass filters 40 and 42 causes the center operating frequency of the directional coupler to be shifted to a lower frequency.

If desired, only one of the low pass filters can be used with the same effect. If low pass filter 40 or 42 was omitted, the center operating frequency would be shifted higher.

Figure 3:
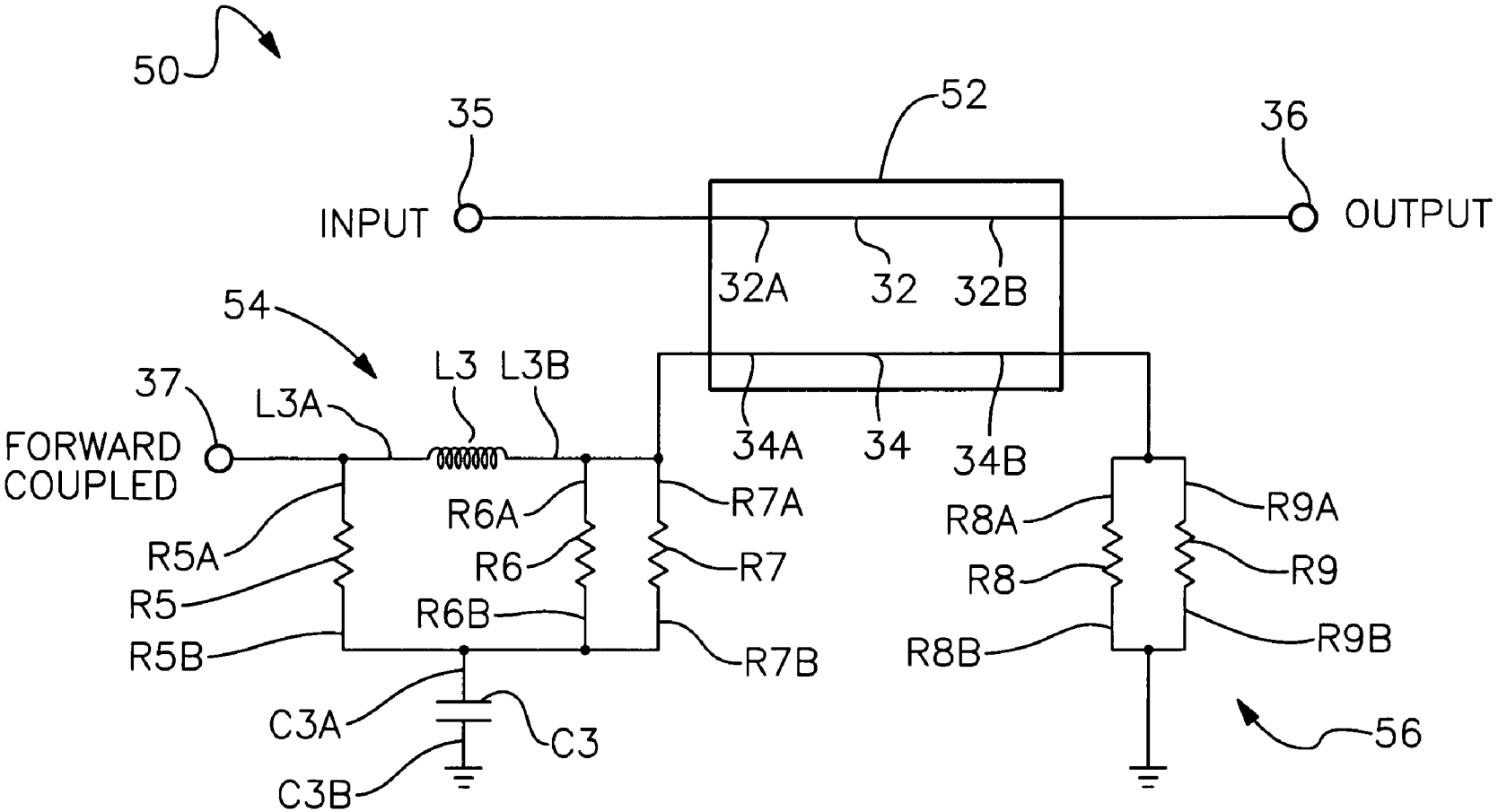
FIG. 3 is a schematic drawing of another embodiment of a directional coupler in accordance with the present invention.

Referring to FIG. 3, a schematic drawing of another embodiment of a directional coupler is shown. Directional coupler 50 has a substrate 52 containing a pair of coupled circuit lines 32 and 34. Circuit lines 32 and 34 are typically formed in a stripline configuration as will be discussed later. Circuit line 32 has ends 32A and 32B. Circuit line 34 has ends 34A and 34B. Directional coupler 50 has three ports, an input port 35, an output port 36 and a forward coupled port 37. Input port 35 is connected to end 32A. Output port 36 is connected end 32B.

A low pass filter 54 is connected between end 34A and forward coupled port 37. A resistor network 56 is connected between end 34B and ground.

Low pass filter 54 has an inductor L3 with ends L3A and L3B. End L3A is connected to forward coupled port 37 and end L3B is connected to circuit line end 34A. Resistor R6 has ends R6A and R6B. Resistor R7 has ends R7A and R7B. Resistors R6 and R7 are connected in parallel. Resistor ends R6A and R7A are connected together and are also connected to inductor end L3B and circuit line end 34A. Resistor R5 has ends R5A and R5B. End R5A is connected to the junction of forward coupled port 37 and inductor end L3A. A capacitor C3 has ends C3A and C3B. Capacitor end C3A is commoned with resistor ends R5B, R6B and R7B. Capacitor end C3B is connected to ground.

Resistor network 56 has a pair of resistors R8 and R9 connected in parallel. Resistor R8 has ends R8A and R8B. Resistor R9 has ends R9A and R9B. Resistor ends R8A and R9A are connected together and are also connected to circuit line end 34B. Resistor ends R8B and R9B are connected to ground.

Directional coupler 30 can be implemented with circuit lines 32 and 34 having an impedance of 50 ohms. Typical values of resistor R5 is 50 ohms, R6, R7, R8 and R9 are 100 ohms, capacitor C3 and C4 are 2.4 picofarads and inductor L3 is 10 nanohenries. The 1 dB point of low pass filter 54 is 400 MHz. The 3 dB point of low pass filter 54 is 800 MHz.

The use of low pass filter 54 causes the center operating frequency of the directional coupler to be shifted to a lower frequency. Resistor network 56 is an impedance matching termination.

Figure 4:
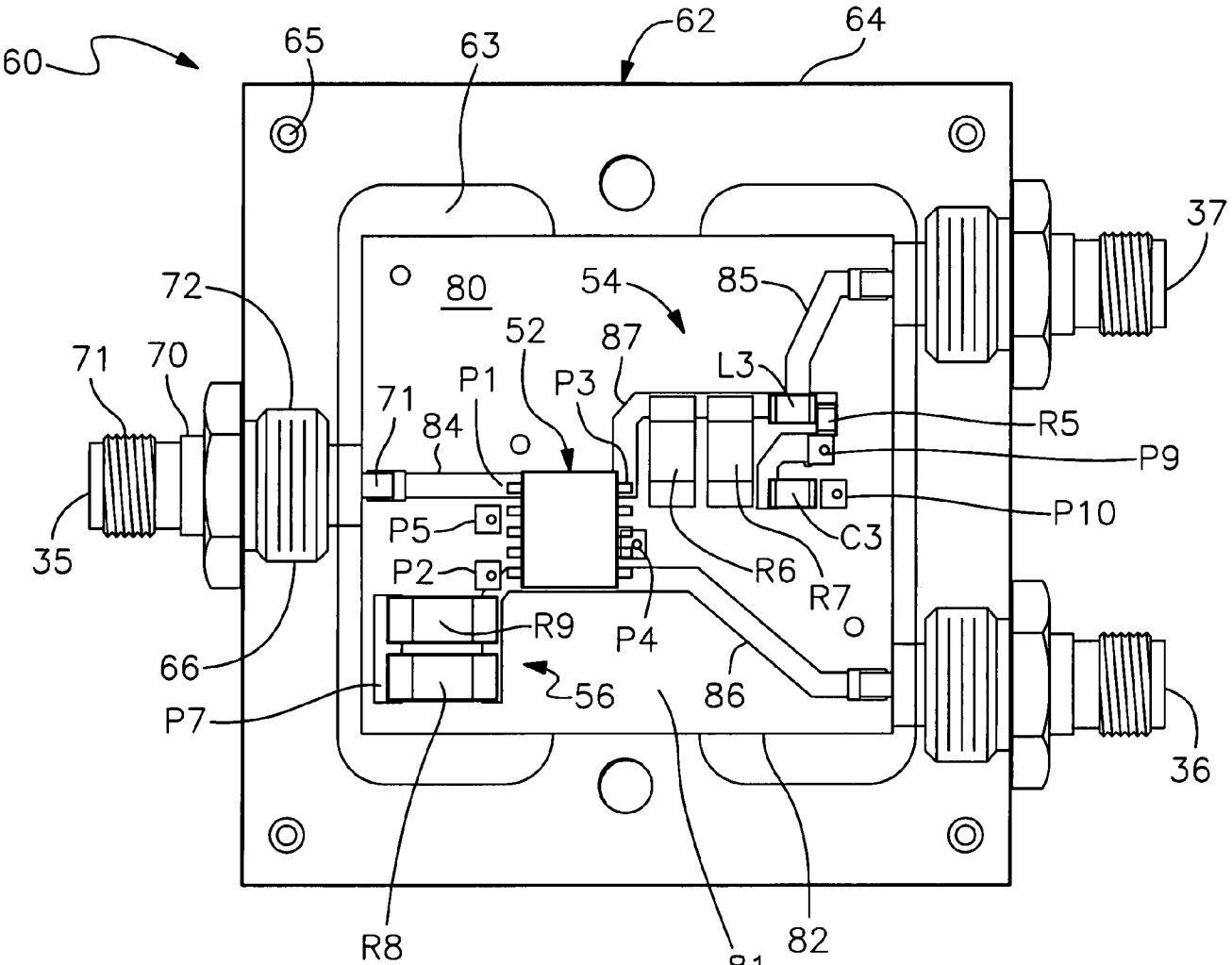
FIG. 4 is a top view of the directional coupler of FIG. 3 packaged in a circuit board, an LTCC substrate and a housing.

Referring to FIG. 4, a top view of directional coupler assembly 60 is shown. FIG. 4 shows the directional coupler 50 of FIG. 3 realized in a physical package.

Directional coupler assembly 60 has a housing 62 with a cavity 63, sides 64 and screw holes 65. Apertures 66 extend through sides 64. Housing 62 would typically be made of metal. A metal cover (not shown) would typically go over cavity 63 and be attached with screws into holes 65.

Several coaxial connectors 70 are threaded into apertures 66. Coaxial connectors 70 have threaded ends 71 and 72 and a pin 74. Coaxial connectors 70 serve as input port 35, output port 36 and forward coupled port 37. Coaxial connectors 70 can be an SMA type coaxial connector. The reverse coupled port is terminated in a matching impedance created by resistor network 56. Housing 62 would be grounded. Directional coupler assembly 60 is therefore a 3 port device.

A printed circuit board 80 is mounted inside cavity 63. Printed circuit board 80 has a top surface 81 and a bottom surface 82. Bottom surface 82 would typically be glued or soldered into cavity 63. Printed circuit board 80 would typically have several layers that are connected by plated through holes (not shown). Printed circuit board 80 has several conductive lines and conductive pads patterned on top surface 81. Conductive lines 84, 85, 86 and 87 are located on top surface 81. Conductive pads P1, P2, P3, P4, P5, P6, P7, P8, P9 and P10 are located on top surface 81.

Substrate 52, low pass filter 54 and resistor network 56 are mounted on top surface 81. An inductor L3, resistors R5, R6, R7, R8, R9 and capacitor C3 are soldered to the conductive lines and conductive pads on top surface 81. The inductor capacitor and resistors can be conventional surface mount electronic components. Conventionally, a solder paste is screened onto selected lines and pads and the components placed with a pick and place machine and the solder paste is then reflowed.

Inductor end L3A is soldered to conductive line 85. Inductor end L3B is soldered to conductive line 87. Resistor ends R6A and R7A are soldered to conductive line 87. Resistor ends R6B and R7B are soldered to conductive pad P8. Resistor end R5A is soldered to conductive line 85. Resistor end R5B is soldered to conductive pad P9. Capacitor end C3A is soldered to conductive pad P8 and end C3B is soldered to conductive pad P10. Resistor ends R8A and R9A are soldered to conductive pad P2. Resistor ends R8B and R9B are soldered to conductive pad P7. An end of conductive lines 84, 85 and 86 are soldered to connector pins 74.

Figure 5:
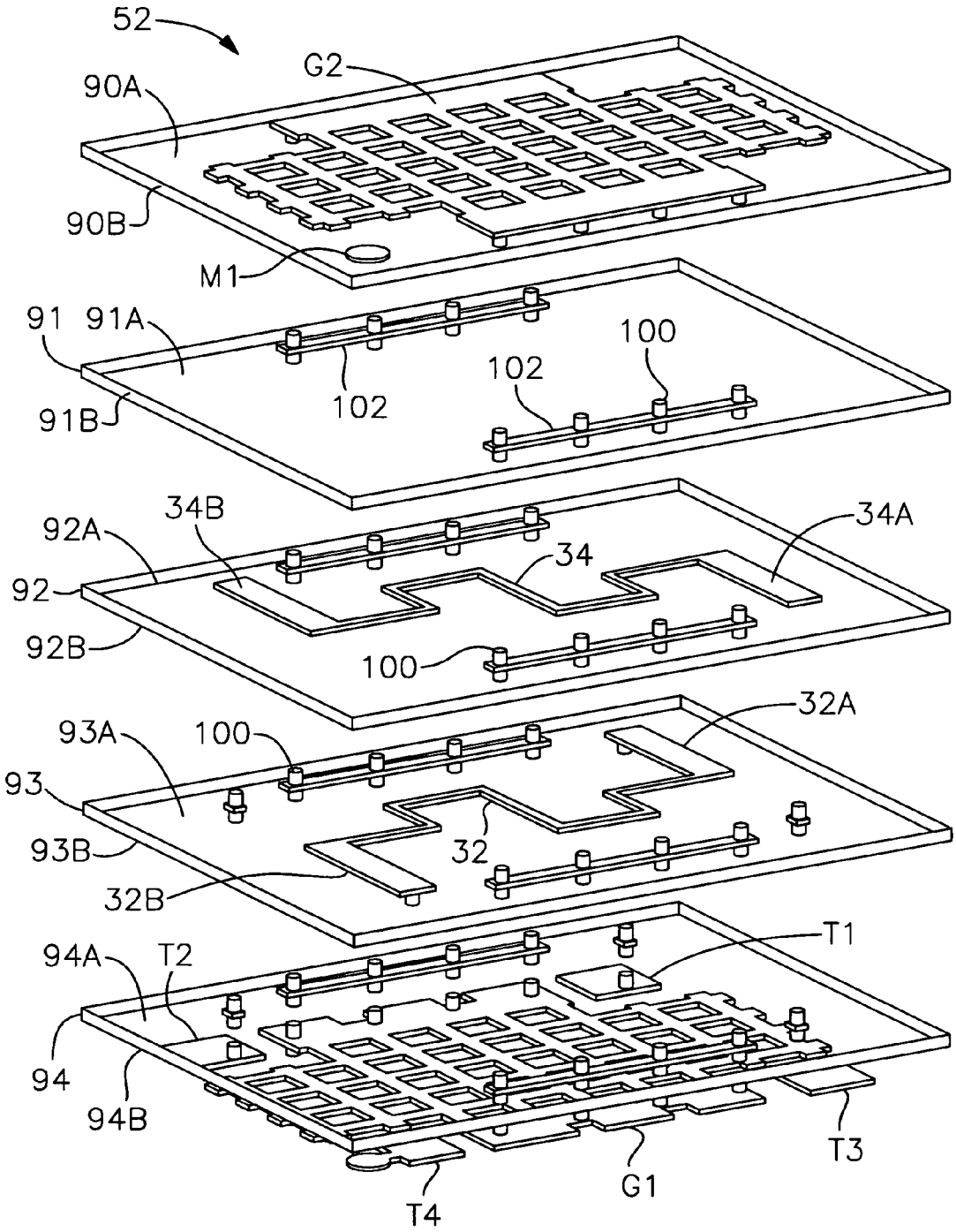
FIG. 5 is an exploded perspective view of the LTCC substrate of FIG. 4 showing the inner layers.

Referring now to FIG. 5, an exploded perspective view of substrate 52 is shown. Substrate 52 is a multi-layered dielectric substrate 52 formed from layers of low temperature co-fired ceramic (LTCC) material. Substrate 52 is comprised of multiple layers 90, 91, 92, 93 and 94 of LTCC material. There are 5 LTCC layers in total. Substrate 52 has a top surface 90A and bottom surface 94B. Various circuit features are patterned on the layers.

Several conductive terminals are located on bottom surface 94B. The terminals are formed from a solderable metal. Terminals T1, T2, T3 and T4 are located on bottom surface 94B. Ground shield or plane G1 is located on bottom surface 94B. Ground shield or plane G2 is located on top surface 90A. The ground shields would be connected to a source of ground potential.

The terminals and ground plane G1 are used to electrically connect substrate 52 to printed circuit board 80. The terminals and a portion of ground plane G1 would be soldered to printed circuit board 80. An orientation mark M1 is placed on top surface 90A in order to prevent incorrect installation on the printed circuit board 80. Terminal T1 is soldered to conductive pad P1. Terminal T2 is soldered to conductive pad P2. Terminal T3 is soldered to conductive pad P3. Terminal T4 is soldered to conductive pad P4. Ground plane G1 is soldered to conductive pads P5 and P6.

Planar layers 90, 91, 92, 93, and 94 are all stacked on top of each other and form a unitary structure 52 after firing in an oven. Layer 90 is the top layer, layer 94 is the bottom layer and layers 91, 92 and 93 form inner layers. The layers are commercially available in the form of an unfired tape. Each of the layers has a top surface 90A, 91A, 92A, 93A and 94A. Similarly, each of the layers has a bottom surface 90B, 91B, 92B, 93B and 94B. The layers have several circuit features that are patterned on the surfaces. Multiple vias 100 extend through each of the layers. Vias 100 are formed from an electrically conductive material and electrically connect the circuit features on one layer to the circuit features on another layer.

Coupled circuit line 32 is formed on surface 93A. Coupled circuit line 34 is formed on surface 92A. Coupled circuit line 32 has ends 32A and 32B. Coupled circuit line 34 has ends 34A and 34B. Circuit lines 32 and 34 have a snake like or sinuous shape and are located directly above each other on different planes. Circuit lines 32 and 34 are separated by layer 92. Circuit lines 32 and 34 are electromagnetically coupled through the dielectric medium of layer 92. The circuit lines are formed from a conductive metal material. Circuit lines 32 and 34 are referred to as striplines because they are sandwiched between ground or reference planes G1 and G2.

A mesh ground shield or plane G2 is formed on surface 90A. Another mesh ground shield or plane G1 is formed on surface 94B. Lines 102 connect several of the grounded vias together on layers 91, 92 and 93.

The circuit features such as the vias, circuit lines, terminals and ground planes are formed by screening a thick film paste material and firing in an oven. This process is well known in the art. First, layers of low temperature co-fired ceramic have via holes punched, the vias are then filled with a conductive material. Next, the circuit features are screened onto the layers. The terminals, lines and ground planes are formed with a conductive material. The layers are then aligned and stacked on top of each other to form substrate 52. The substrate 52 is then fired in an oven at approximately 900 degrees centigrade to form a single unitary piece.

A directional coupler in the form of substrate 52 and directional coupler assembly 60 were designed, fabricated and tested for electrical performance. Substrate 52 was designed with an 1800 MHz center operating frequency. Directional coupler assembly 60 with substrate 52 and low pass filter 54 operates at a 900 MHz center frequency.

Substrate 52 as built and tested had an overall substrate size of 0.3 inches by 0.25 inches by 0.27 inches. The circuit lines 32 and 34 had a line width of 0.005 inches and a line thickness of 0.0003 inches.

Directional coupler assembly 60, used the following component values: resistor R5 50 ohms; resistors R6, R7, R8 and R9 100 ohms; capacitor C3, C4 2.4 picofarads and inductor L3 10 nanohenries.

Figure 6:
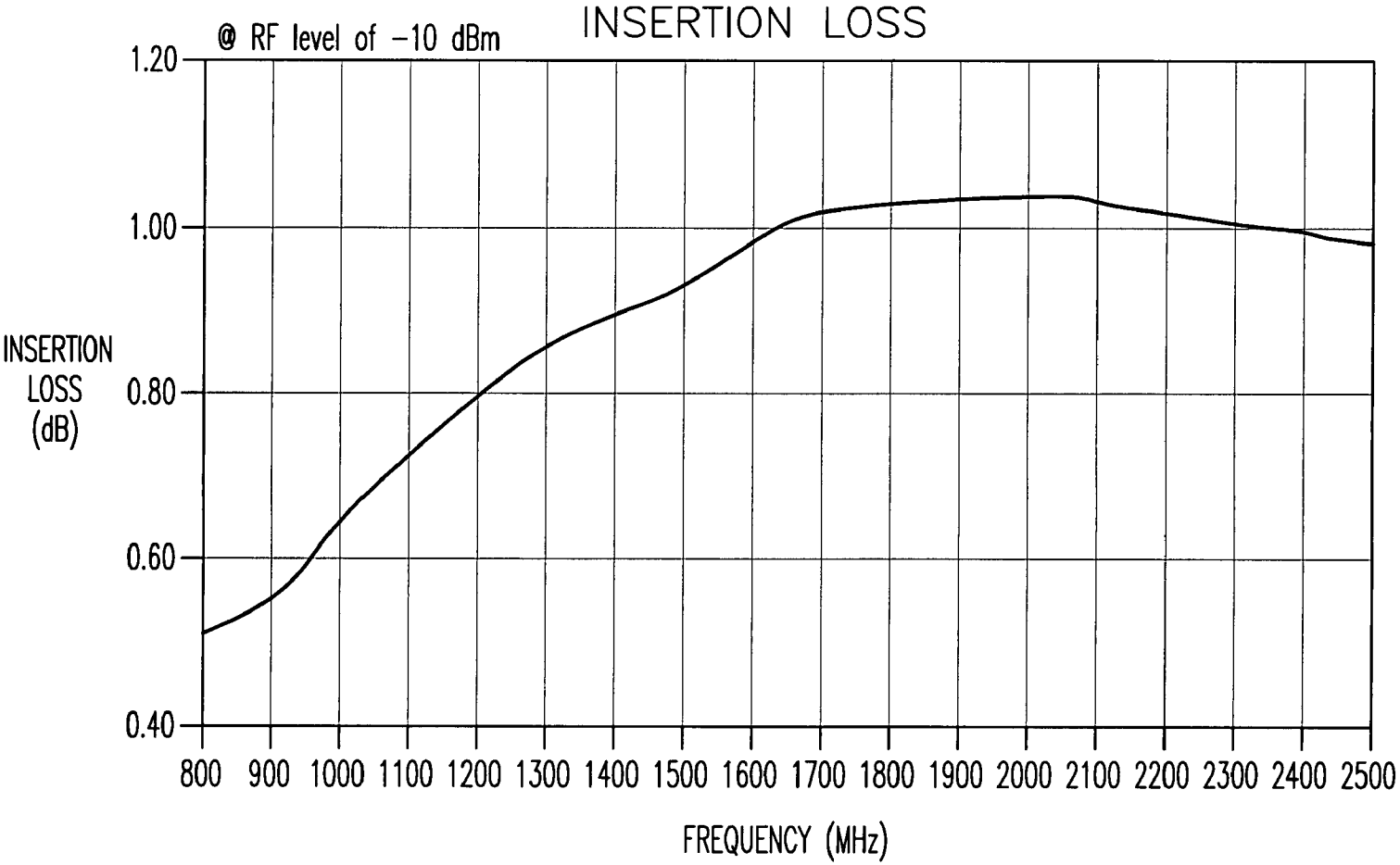
FIG. 6 is a graph of insertion loss versus frequency for a directional coupler.
Figure 7:
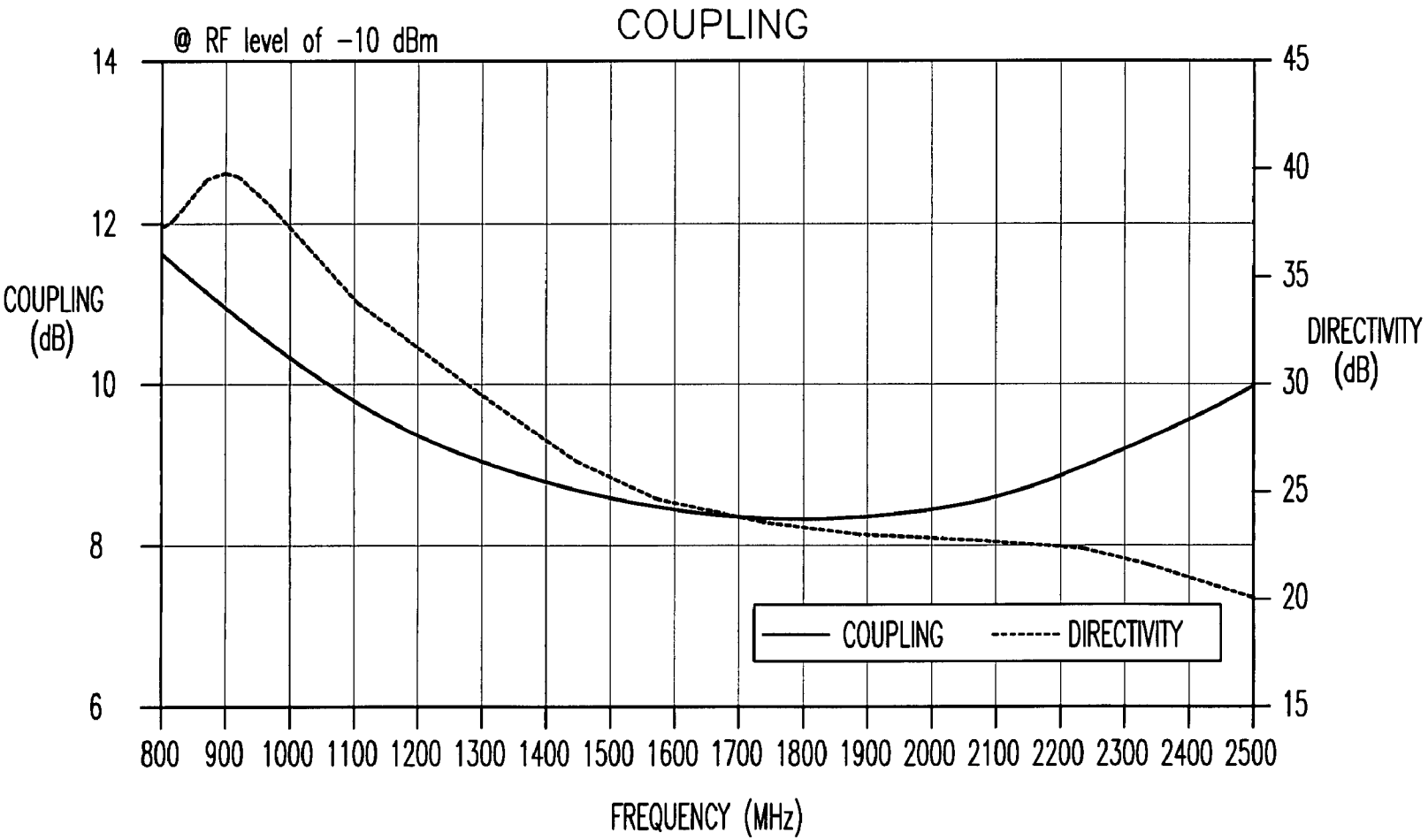
FIG. 7 is a graph of coupling versus frequency for a directional coupler.
Figure 8:
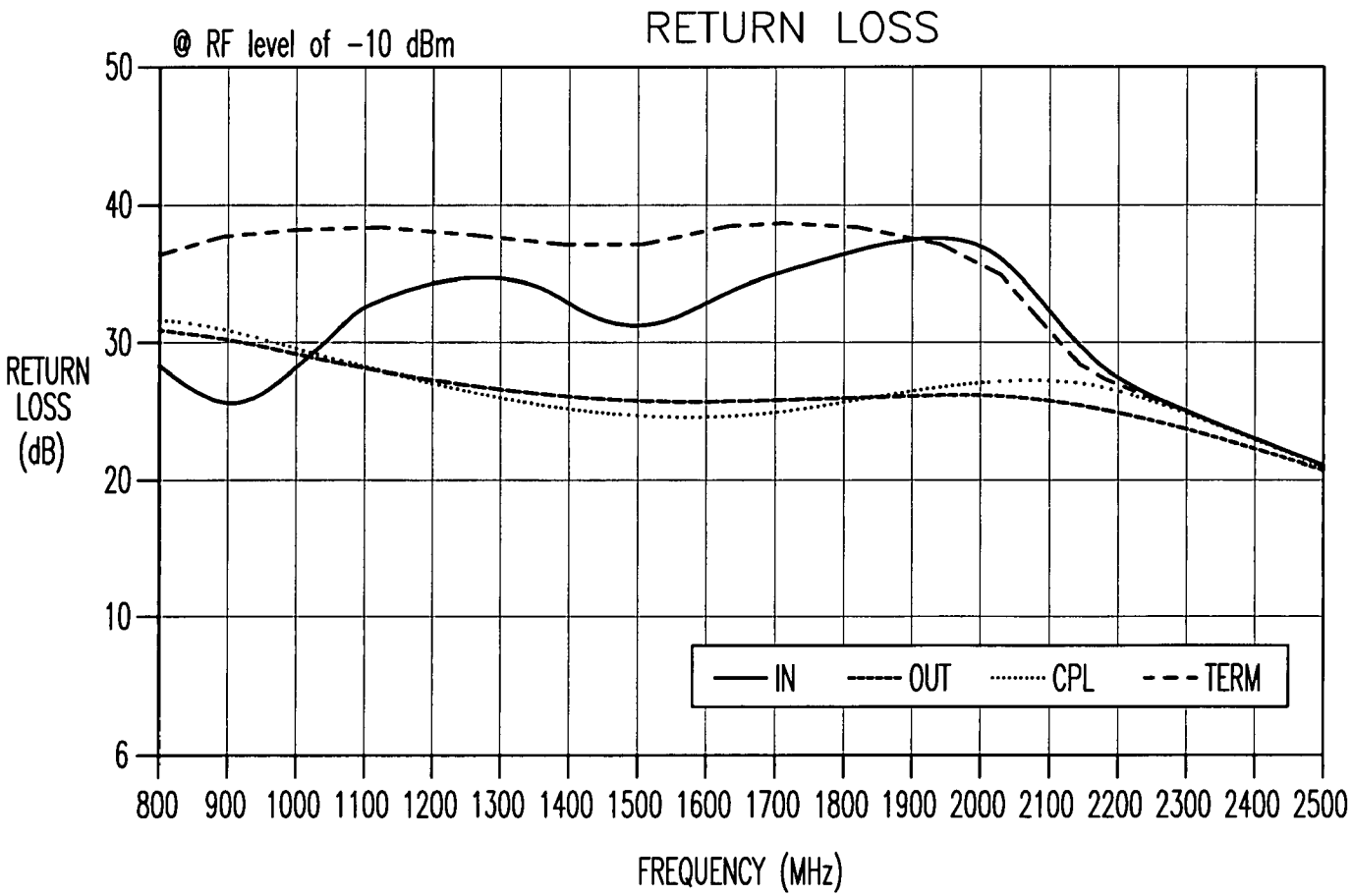
FIG. 8 is a graph of return loss versus frequency for a directional coupler.
Figure 9:
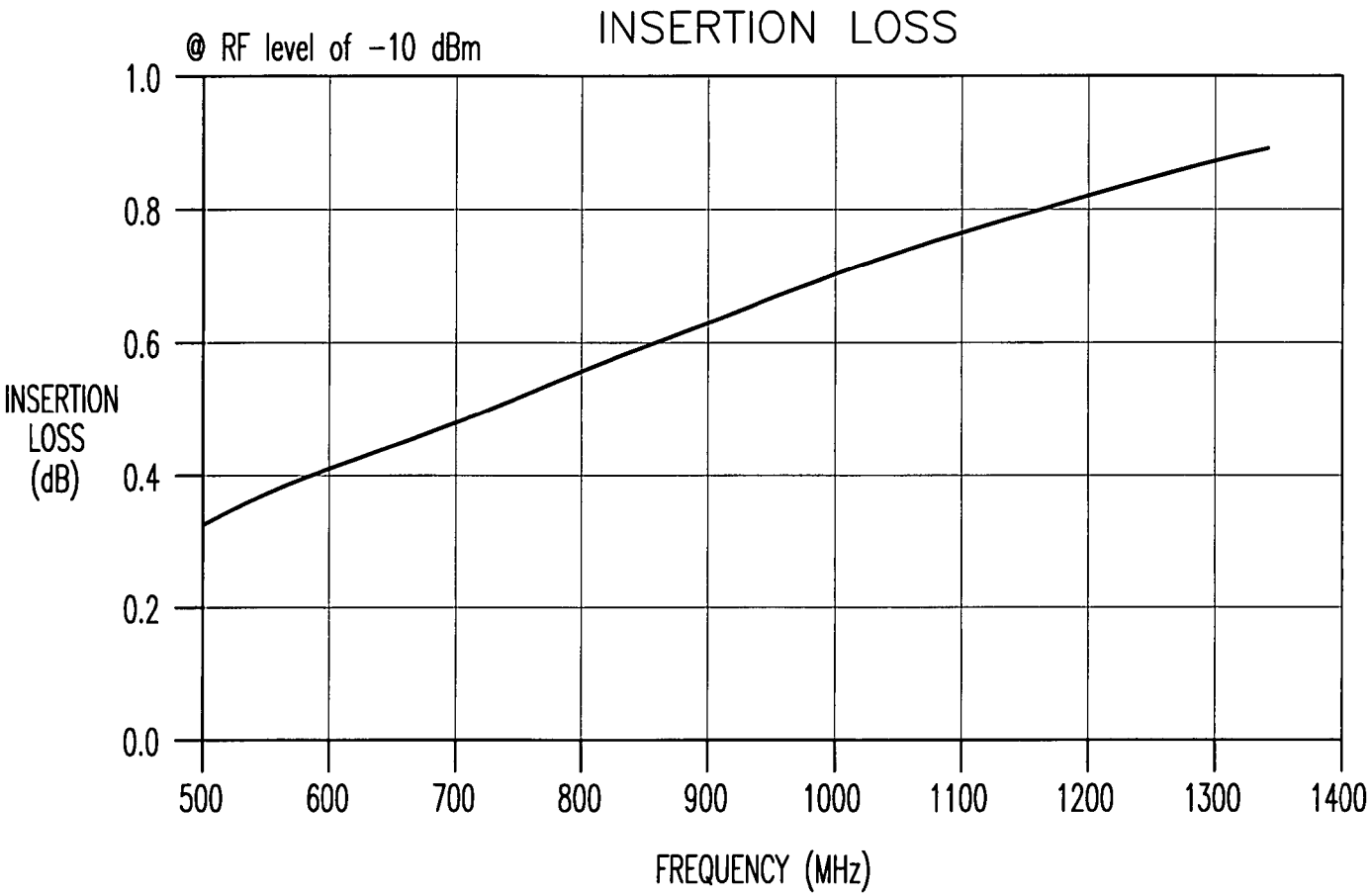
FIG. 9 is a graph of insertion loss versus frequency for the directional coupler of FIG. 3.
Figure 10:
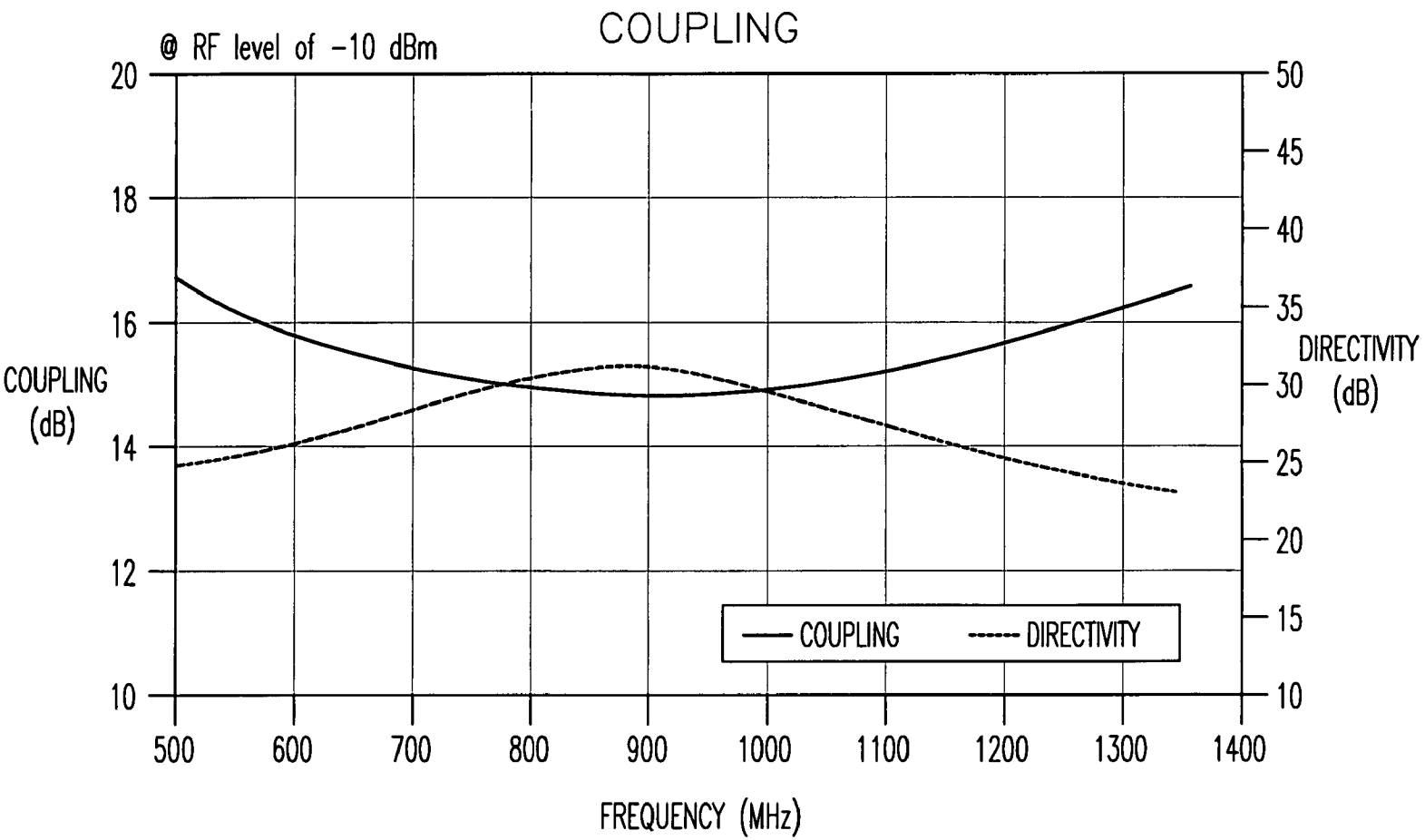
FIG. 10 is a graph of coupling versus frequency for the directional coupler of FIG. 3.
Figure 11:
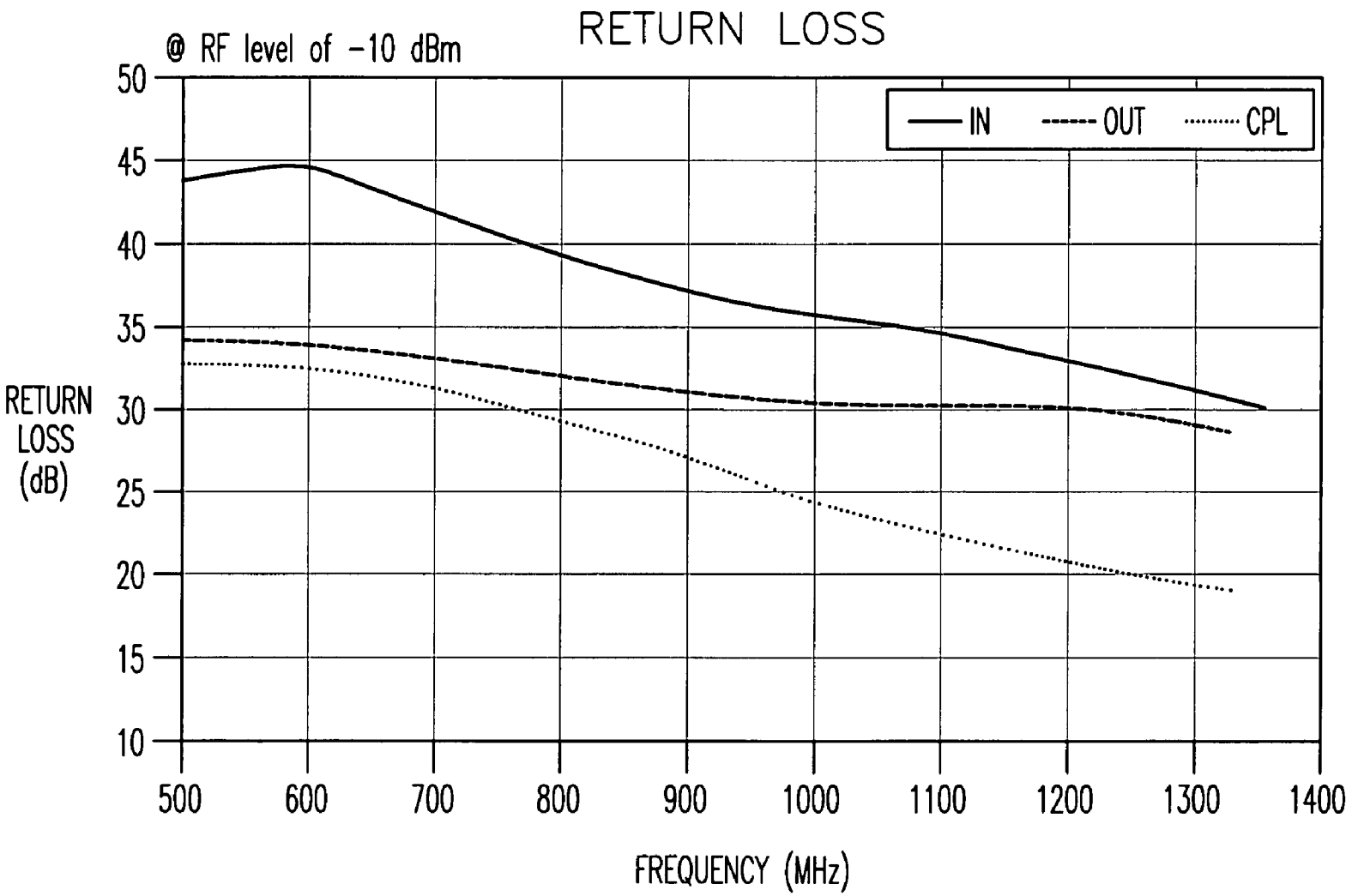
FIG. 11 is a graph of return loss versus frequency for the directional coupler of FIG. 3.

FIGS. 6–8 show the electrical performance of the coupled circuit lines of substrate 52 without the use of the low pass filter. FIGS. 9–11 show the electrical performance of substrate 52 mounted in assembly 60 with the use of the low pass filter 54 and resistor network 56.

Turning now to FIGS. 6–8, a graph of insertion loss versus frequency for substrate 52 is shown in FIG. 6. FIG. 7 shows a graph of coupling versus frequency for substrate 52. FIG. 8 is a graph of return loss versus frequency for substrate 52. The operating frequency is centered at 1800 MHz.

Turning now to FIGS. 9–11, a graph of insertion loss versus frequency for directional coupler assembly 60 is shown in FIG. 9. FIG. 10 shows a graph of coupling versus frequency for directional coupler assembly 60. FIG. 11 is a graph of return loss versus frequency for directional coupler assembly 60. The operating frequency is centered at 900 MHz.

The present invention has several advantages. The present invention allows for flexibility in designing directional couplers for differing frequencies. The same substrate 52 can be used for many different center frequencies just by changing the component values in the low pass filters. This allows for a fast design cycle for prototype parts and production. The present invention provides an improvement over previous directional coupler designs.

The use of substrate 52 over a range of frequencies results in lower costs as the same part is used for several design applications.

The use of a high frequency part for lower frequencies results in a smaller size component.

The directivity of the directional coupler is improved.

Since, high frequency couplers have good power handling, directional coupler 60 also has good power handling capabilities at low frequencies of operation.

Fabricating the substrate 52 using a low temperature co-fired ceramic process results in more uniform electrical characteristics.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed is:

1. A directional coupler comprising:

a) a first circuit line having a first end and a second end;

b) an input port connected to the first end and an output port connected to the second end;

c) a second circuit line having a third end and a fourth end, the first and second circuit lines located proximate to each other such that they are electromagnetically coupled;

d) a forward coupled port connected to the third end and a reverse coupled port connected to the fourth end;

e) a first low pass filter having a constant impedance, said first low pass filter connected to the forward coupled port, said first low pass filter shifting the operating frequency of the directional coupler to a lower frequency and thereby maintaining a predetermined return loss, said low pass filter having a filter response to flatten the coupling response outside of the usable band of the coupler.

2. The directional coupler according to claim 1, wherein the first low pass filter comprises:

a first resistor having a first and second end, the first end of the first resistor connected to the forward coupled port;

a second resistor having a third and fourth end, the third end of the second resistor connected to the third end of the second circuit line;

a third resistor connected in parallel with and in the same manner as said second resistor, said third resistor utilized, when required, by power levels, a first capacitor having one end connected to the second end of the first resistor and the fourth end of the second resistor, the other end of the first capacitor connected.

3. The directional coupler according to claim 1, wherein the first and second circuit lines have a sinuous shape.

4. The directional coupler according to claim 2, wherein a fourth and fifth resistor are connected in parallel between the reverse coupled port and ground.

5. The directional coupler according to claim 1, wherein a second low pass filter is connected to the reverse coupled port, said first and said second low pass filter shifting the operating frequency of the directional coupler to a lower frequency and thereby maintaining a predetermined return loss.

6. The directional coupler according to claim 5, wherein the second low pass filter comprises:

a second inductor connected between the reverse coupled port and the fourth end;

sixth resistor having a first and second end, the first end of the sixth resistor connected to the reverse coupled port;

a seventh resistor having a third and fourth end, the third end of the seventh resistor connected to the fourth end of the second circuit line;

a second capacitor having one end connected to the second end of the sixth resistor and the fourth end of the seventh resistor, the other end of the second capacitor connected to ground.

7. A directional coupler comprising:

a) a multi-layered substrate, the substrate having an upper surface and a lower surface;

b) a first circuit line located within the substrate on a first layer and having a first and second end, the first end connected to an input port and the second end connected to an output port;

c) a second circuit line located within the substrate on a second layer and having a third and fourth end, the fourth end connected to a reverse coupled port;

d) a first, second, third and fourth terminal located on the lower surface;

e) a first via extending between the first terminal and the first end;

f) a second via extending between the second terminal and the second end;

g) a third via extending between the third terminal and the third end;

h) a fourth via extending between the fourth terminal and the second end; and i) a first low pass filter connected between the third end and a forward coupled port, said first low pass filter shifting the operating frequency of said directional coupler to a lower frequency, said low pass filter having a filter response to flatten the coupling response outside of the usable band of the coupler, in turn, comprising: a first inductor connected between the forward coupled port and the third port.

8. The directional coupler according to claim 7, wherein the first low pass filter comprises:

a first resistor having a first and second end, the first end of the first resistor connected to the forward coupled port;

a second resistor having a third and fourth end, the third end of the second resistor connected to the third end of the second circuit line;

a first capacitor having one end connected to the second end of the first resistor and the fourth end of the second resistor, the other end of the first capacitor connected to ground.

9. The directional coupler comprising:

a) a high frequency stripline coupler including a first and second coupled circuit line, the circuit lines located between a first and second ground plane;

b) a first low pass filter connected to the second circuit line, the low pass filter shifting the operating frequency of the directional coupler to a lower frequency, said first low pass filter, in turn, comprises:

an inductor having a first and second end, the second end of the inductor connected to the second circuit line;

a first resistor having a first and second end, the first end of the resistor connected to the first end of the inductor;

a second resistor having a third and fourth end;

a third resistor having a fifth and sixth end, the third and fifth ends of the resistors connected to the second end of the inductor;

a capacitor having a seventh and eighth end, the seventh end of the capacitor connected to the second, fourth and sixth ends of the resistors, the eighth end of the capacitor connected to ground.

10. The directional coupler according to claim 9, wherein the first low pass filter has a constant impedance.

11. The directional coupler according to claim 9 wherein said high frequency stripline coupler has a reverse coupled port and said second coupled circuit line has a first end and a second end and wherein said second low pass filter is connected between the reverse coupled port and the second end of said second coupled circuit line.

12. The directional coupler according to claim 9 wherein said high frequency stripline coupler has a forward coupled port and said second coupled circuit line has a first end and a second end and wherein said first low pass filter is connected between the forward coupled port and the first end of said second coupled circuit line.

13. The directional coupler according to claim 12, wherein a resistor network is connected between the reverse coupled port and the second end of the second coupled circuit line.

14. The directional coupler according to claim 9, wherein the first and second circuit lines have a sinuous shape.

15. The directional coupler according to claim 9, further comprising a multilayer substrate, said substrate having an upper surface and a lower surface and wherein the substrate and the low pass filter are mounted on a printed circuit board having an upper surface and lower surface.

16. The directional coupler according to claim 15, wherein the printed circuit board has a first and second terminal disposed on the lower surface and has a third circuit line connected to the first terminal and a fourth circuit line connected to the second terminal and a fifth circuit line connected to the low pass filter.

17. The directional coupler according to claim 16, wherein the printed circuit board is mounted in a housing.

18. The directional coupler according to claim 17, wherein a first, second and third coaxial connector are mounted to the housing, the first coaxial connector connected to the third circuit line, the second coaxial connected to the fourth circuit line and the third coaxial connector connected to the fifth circuit line.

19. A directional coupler comprising:

a) a printed circuit board, having an input port, an output port and a forward coupled port;

b) a substrate mounted to the printed circuit board, the substrate having a plurality of layers and an upper surface and a lower surface;

c) a first and second coupled circuit line located within the substrate on different layers, the first circuit line having a first and second end, the first end connected to the input port and the second end connected to the output port, the second circuit line having a third and fourth end, the fourth end connected to a termination; and d) a first low pass filter mounted to the printed circuit board and connected between the third end and the forward coupled port, said first low pass filter shifting the operating frequency of said directional coupler to a lower frequency, said low pass filter having a filter response to flatten the coupling response outside of the usable band of the coupler, in turn, comprising:

a first inductor connected between the forward coupled port and the third port.

20. The directional coupler according to claim 19, wherein the first low pass filter comprises:

a first and second resistor connected in parallel across the first inductor;

a first capacitor connected between the first and second resistors and ground.

21. The directional coupler according to claim 19, wherein the termination is an impedance matching resistor network.

22. The directional coupler according to claim 19, wherein a resistor network is mounted to the printed circuit board and is connected between ground and the fourth end.

* * * * *